US005785634A

United States Patent [19]

Lavore

[11] Patent Number: 5,785,634

[45] Date of Patent: Jul. 28, 1998

[54] WHEELED UPPER BODY EXERCISE DEVICE

[76] Inventor: Joseph S. Lavore, 6492 Sugar Tree Dr., Spring Hill, Fla. 34607

[21] Appl. No.: 808,874

[22] Filed: Feb. 28, 1997

[51] Int. Cl.[6] ..... A63B 23/04

[52] U.S. Cl. ..... 482/111; 482/908

[58] Field of Search ..... 482/55, 111, 112, 482/57, 51, 52, 62, 58, 908; 434/254

[56] References Cited

U.S. PATENT DOCUMENTS

| | | | |
|---|---|---|---|
| 1,279,633 | 9/1918 | Allen | 482/111 |
| 4,784,385 | 11/1988 | D'Angelo | 482/111 |
| 5,217,420 | 6/1993 | Abboudi et al. | 482/55 |
| 5,316,532 | 5/1994 | Butler | 482/111 |
| 5,328,423 | 7/1994 | Abboudi et al. | 482/111 |
| 5,586,961 | 12/1996 | Quint | 482/62 |

*Primary Examiner*—Stephen R. Crow
*Attorney, Agent, or Firm*—American Innovations, Inc.; Dorothy Morse, Esq.

[57] ABSTRACT

An exercise device for use under water to exercise muscles associated with a person's upper extremities, the device comprising a wheel support member, a wheel, a plurality of paddles, and a handle, the wheel support member being anchored to the side or bottom of a swimming pool or other body of water. The wheel is movably attached to the wheel support member so that the wheel can revolve around its central axis during use. Each paddle is removably attached to one of the sides of the wheel, or in the alternative to its perimeter, with means that allow the orientation of each paddle to be individually changed into a variety of fixed positions between a first position of maximum water resistance and a second position that is rotated ninety degrees from the first position and creates a position of minimum water resistance. The handle of the exercise device is removably attached to the wheel through means that allow the handle to be positioned at different distances from the central axis of the wheel to provide varying ranges of upper extremity extension and motion to an operator gripping the handle with one of his or her hands and using the handle to rotate the wheel in both clockwise and counterclockwise directions. Applications may include, but are not limited to, use in exercising arm, shoulder, pectoral, and back muscles, aerobic training, therapy, strengthening hands and arms, and rehabilitation.

14 Claims, 3 Drawing Sheets

WHEELED UPPER BODY EXERCISE DEVICE

BACKGROUND

1. Field of Invention

This invention relates to variable resistance underwater exercise devices, specifically to an exercise device for use under water to exercise muscles associated with a person's upper extremities, the device comprising a wheel support member, a wheel, a plurality of paddles, and a handle, the wheel support member being anchored to the side or bottom of a swimming pool or other body of water, the wheel being movably attached to the wheel support member so that the wheel can revolve around its central axis during use, each paddle being removably attached to one of the sides of the wheel or in the alternative to its perimeter with means that allow the orientation of each paddle to be individually changed into a variety of fixed positions between a first position of maximum water resistance and a second position that is rotated ninety degrees from the first position and creates a position of minimum water resistance, and the handle being removably attached to the wheel through means that allow the handle to be positioned at different distances from the central axis of the wheel to provide varying ranges of upper extremity extension and motion to an operator gripping the handle with one of his or her hands and using the handle to rotate the wheel in both clockwise and counterclockwise directions. Applications may include, but are not limited to, use in exercising arm, shoulder, pectoral, and back muscles, aerobic training, therapy, strengthening hands and arms, and rehabilitation.

2. Description of Prior Art

Variable resistance underwater exercise devices are known. The invention in U.S. Pat. No. 4,784,385 to D'Angelo (1988) discloses a pair of rotatable disc assemblies adjustably mounted on a support structure having a pair of support arms, each disc assembly comprising a flat disc, a shroud, a plurality of flat blades, and a gear assembly for varying the angular orientation of the flat blades with respect to each disc. Although the D'Angelo invention provides a user with varying resistance, it does not provide a user with a varying range of upper extremity extension and motion, as does the present invention with its movable handle. In contrast, the invention in U.S. Pat. No. 5,531,657 to Macedo (1996) comprises an elongated gripping bar with removable resistance members attached to each of its ends. Each resistance member has a shaft portion and a planar fin interlocking therewith to provide a plurality of fin surfaces which create resistance during their movement through water. The Macedo invention is gripped by a user's hands and moved freely through water. In contrast, the present invention provides a use with more precisely controlled upper extremity movement, making it more useful than the Macedo invention for rehabilitative purposes. A device similar in configuration to the Macedo invention is disclosed in U.S. Pat. No. 5,478,312 to Weissbuch (1995). Further, a support base for aquatic exercise devices is disclosed in U.S. Pat. No. 5,533,950 to Lochbaum (1996). The Lochbaum invention comprises a base member which releasably secures both an exercise device and a user thereto during exercise. The base member is sectioned, comprises leveling means, and has apertures for receipt of exercise devices so that a user can remain securely positioned adjacent to an exercise device during its use.

The prior art thought to be most closely related to the present invention are the inventions disclosed in U.S. Pat. No. 5,487,713 to Butler (1996) and U.S. Pat. No. 4,162,788 to Turnier (1979). The Turnier invention comprises a body supporting section upon which a user would be horizontally positioned, and front and back wheels each attached to pedals that would be individually rotated by the user's hands and feet, respectively, during use. Cog-like driving members providing resistance to the user's extremities are secured on the outside of each wheel. The Butler invention comprises a water-filled treatment vessel designed with anti-splash features and an adjustable exercise device having a pedal assembly connected to a series of concentrically interconnected discs. The pedal assembly is attached to a frame that is suspended into the treatment vessel by a cantilevered support member. The frame is adjustably connected to the support member to vary the vertical position of the frame within the treatment vessel and is also adjustable in length to accommodate people of differing stature. Incrementally spaced receptors in each disc, along radii thereof, removably receive a user's lower extremities and allow each lower extremity to achieve a different path of travel. Alternately, handlebars which communicate with the pedal assembly can be used to drive the concentric discs. The Butler invention also comprises a water-powered piston assembly attached to the cycle component to provide effortless movement of a user positioned upon the exercise device in and out of the treatment vessel. The present invention differs from both the Turnier and Butler inventions in that the present invention provides variable resistance for a user through changes in paddle orientation between a first position of maximum resistance and a second position rotated ninety degrees from the first position and creating a position of minimum resistance. The present invention also provides a variable range of upper extremity extension and motion through changes in handle position relative to the central axis of the wheel. It is not known to have an exercise device for use underwater to exercise muscles associated with a person's upper extremities, the device comprising a wheel, a plurality of paddles removably attached to the wheel, a handle also removably attached to the wheel, and a wheel support member, the central axis of the wheel being movably attached to the wheel support member so that the wheel can revolve around its axis during use, the paddles being able to be positioned into fixed orientations between a first position of maximum resistance and a second position rotated ninety degrees from the first position and creating minimum resistance in water to provide a user with varying levels of resistance, and the handle being capable of being positioned at varying distances from the central axis of the wheel to provide a user with varying ranges of upper extremity extension and motion.

SUMMARY OF INVENTION

Objects and Advantages

It is the primary object of this invention to provide an underwater exercise device for use in exercising the muscles in a person's shoulder and arms, and other muscles associated therewith. It is also an object of this invention to provide a variable resistance underwater exercise device. A further object of this invention is to provide an adjustable underwater exercise device which can offer differing amounts of extension and motion to an operator's upper extremities for effective rehabilitative use. It is also an object of this invention to provide an underwater exercise device with a wheel which can be rotated in both clockwise and counterclockwise directions.

As described herein, properly manufactured and positioned for use within a swimming pool or other body of water, the present invention would provide a resistive exercise device having a plurality of paddles attached to a rotatable wheel. In the preferred embodiment it is contemplated for the wheel to be positioned relative to an operator so that one of its sides faces the operator during use, and for the paddles to be either attached to the side of the wheel remote from the operator, or attached to the wheel so as to extend radially outward from its perimeter. A handle is attached to the side of the wheel facing the operator. During use, an operator grips the handle with one of his or her hands and rotates the wheel in either a clockwise or a counterclockwise direction. The paddles provide varying amounts of resistance as they are moved through water. Although the orientation of each paddle is fixed with respect to the wheel during use, each paddle is capable of being fixed into a variety of positions between a first position of maximum resistance and a second position rotated ninety degrees therefrom and providing minimum resistance. The position of the handle on the wheel, relative to the wheel's central axis, can also be adjusted to provide varied amounts of extension and motion for an operator's upper extremities while his or her hand grips the handle and rotates the wheel. Paddles are each attached to a casing on the wheel with locking buttons having spring means to outwardly bias them into an extended position. The locking buttons independently secure each paddle into a variety of orientations between the abovementioned positions of maximum and minimum resistance. The wheel support member may also be adjustable to vary the height of the wheel relative to an operator and the surface level of the body of water used, for optimum use by people of differing stature and fitness levels. It is further contemplated for a weight to be used to anchor the wheel support member either to the side of a swimming pool, or upon the bottom of a swimming pool or other body of water, and for the wheel of the underwater exercise invention to be rotatable in both clockwise and counterclockwise directions.

The description herein provides preferred embodiments of the present invention but should not be construed as limiting the scope of the upper body exercise wheel invention. For example, variations in the number of paddles used, the positioning of the paddles on the wheel, the number of openings through the casing configured to receive an outwardly biased paddle lock button, the length of each paddle, the materials from which the paddles are made, the dimension and configuration of the handle, the means used to adjust the height of the wheel support member, the type of means used for outwardly biasing the paddle lock buttons, the configuration and dimension of the weight used to secure the wheel support member, and the material from which the weight is made, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
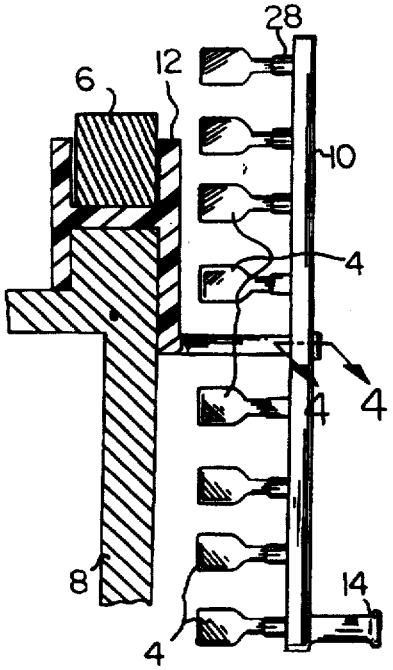
FIG. 1 is a side view of a first embodiment of the invention attached to the side of a swimming pool and having paddles attached to the side of the wheel remote from an operator.

FIG. 1 shows a first preferred embodiment of the present invention having a plurality of paddles 4 each connected by a casing 28 to a wheel 10. FIG. 1 also shows wheel 10 to be planar in configuration, and all paddles 4 connected to the side of wheel 10 positioned adjacent to the side wall of a treatment vessel or swimming pool 8. FIG. 1 further shows a handle 14 connected to the side of wheel 10 remote from paddles 4. Handle 14 is positioned adjacent to the perimeter of wheel 10 in a position providing maximum extension and motion for an operator's upper extremities during use. In the preferred embodiment it is contemplated for the position of handle 14 to be adjustable in distance from the central axis of wheel 10 and thereby provide differing amounts of extension and motion for an operator's upper extremities as the operator grips handle 14 and rotates wheel 10 around its central axis. In addition, FIG. 1 shows the central axis of wheel 10 connected to a wheel support member 12, and wheel support member 12 being anchored by a weight 6 against the side wall of pool 8. As wheel 10 is rotated about its central axis by an operator (not shown), only paddles 4 positioned below the central axis of wheel 10 would be under the water level of pool 8 and in a position to create enhanced resistance for the operator during the exercise of muscles (not shown) associated with his or her upper extremities. In the preferred embodiment of the present invention it is contemplated for paddles 4, wheel 10, and wheel support member 12 to be made from materials inert to chemicals commonly used to treat swimming pool water (not shown).

Figure 2:
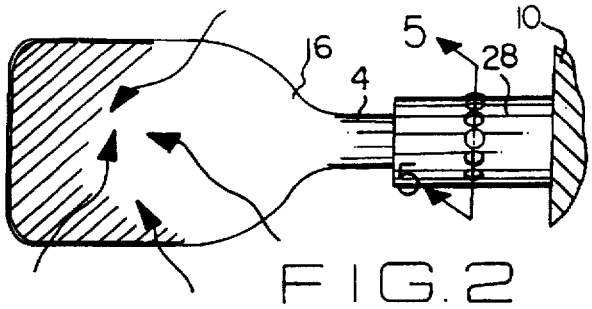
FIG. 2 is a side view of one of the invention paddles oriented in a first position of greatest resistance.
Figure 3:
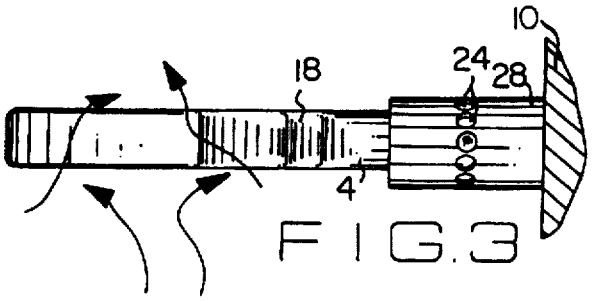
FIG. 3 is a side view of one of the invention paddles oriented in a second position of least resistance.

FIG. 2 shows paddle 4 oriented vertically in position of greatest water resistance 16, while FIG. 3 shows paddle 4 oriented horizontally in a position of least water resistance 18. Since each paddle 4 attached to wheel 10 periodically enters and exits through the water surface in pool 8 as wheel 10 is revolved around its central axis, the positions of greatest and least resistance are designated so as to represent the orientation of each paddle 4 upon its entry into and its exit from the water (not shown). FIGS. 2 and 3 also show paddle 4 attached to casing 28, and casing 28 attached to wheel 10. Although FIGS. 2 and 3 show several openings 24 through casing 28, the number of openings 24 used through each casing 28 is not critical to the present invention.

Figure 4:
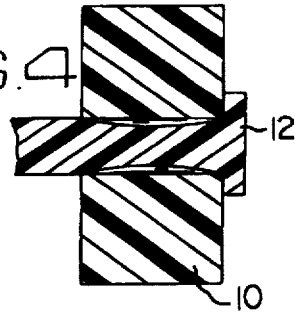
FIG. 4 is an enlarged sectional view, along line 4—4 in FIG. 1 of the attachment of the wheel to the wheel support member of the invention.

FIG. 4 shows the central axis of wheel 10 connected to wheel support member 12. In the first preferred embodiment of the present invention it is contemplated for the connection of wheel 10 to wheel support member 12 to be made so that wheel 10 is freely rotatable in both clockwise and counterclockwise directions. Although not shown, it is also contemplated for wheel 10 to be removable from wheel support member 12 for more efficient storage of wheel 10 and wheel support member 12 during periods of non-use.

Figure 5:
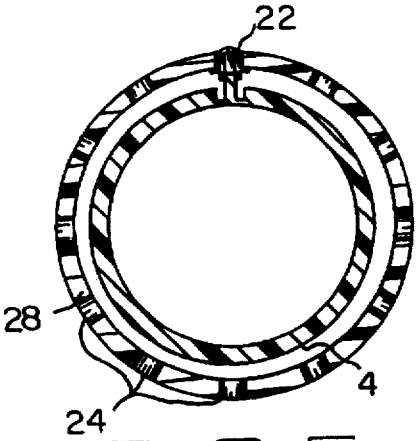
FIG. 5 is an enlarged sectional view of a paddle connected within one of the casings of the invention.

FIG. 5 shows the smaller end of paddle 4 positioned within one end of casing 28, the other end of casing 28 being attached to wheel 10. FIG. 5 also shows a paddle locking button 22 attached to paddle 4 that is biased outwardly to engage one of several openings 24 in casing 28 to secure paddle 4 into a fixed orientation relative to casing 28 during use. Although FIG. 5 shows paddle 4 having one button 22 and twelve openings 24, the number of buttons 22 on each paddle 4 and the number of openings 24 through each casing 28 is not critical to the present invention.

Figure 6:
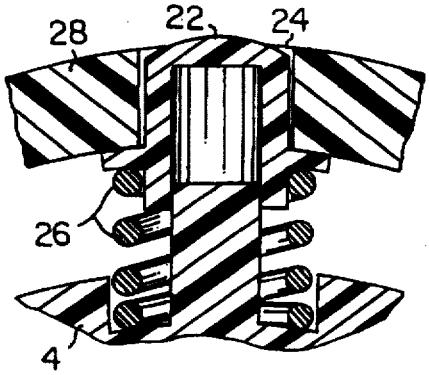
FIG. 6 is a enlarged sectional view along line 5—5 in FIG. 2 of a paddle locking button outwardly biased to engage an opening in one of the invention's casings.

FIG. 6 shows button 22 depending laterally from paddle 4 and biased outwardly to engage opening 24 through casing 28. A coiled spring 26 is shown in FIG. 6 positioned between paddle 4 and the rear portion of button 22 as the means for outwardly biasing button 22 to engage opening 24. Although a coiled spring 26 is shown in FIG. 6, the type of spring means used is not critical to the present invention and other means of outwardly biasing button 22 to engage opening 24 are contemplated.

Figure 7:
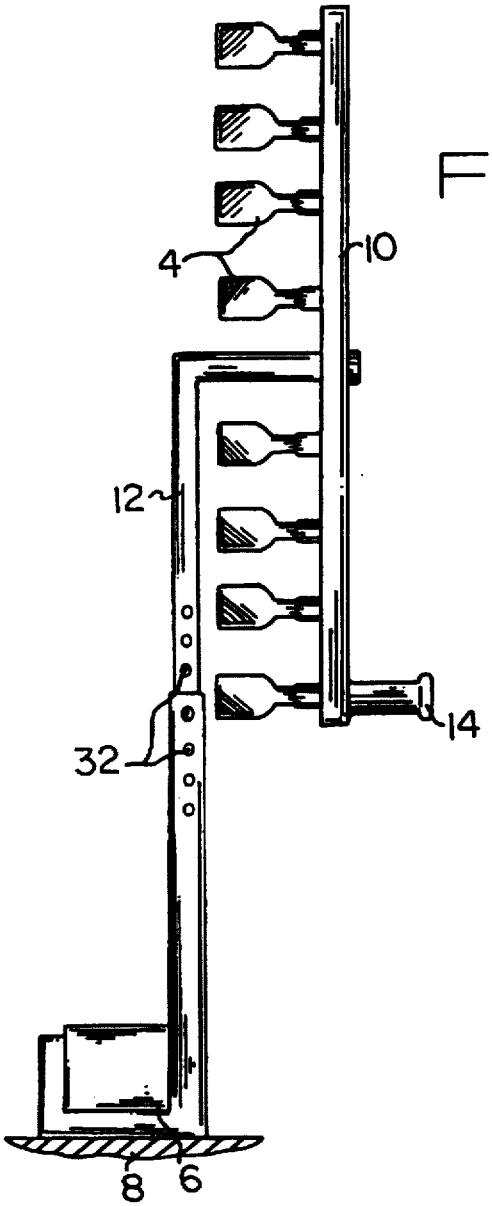
FIG. 7 is a side view of a second embodiment of the invention positioned on the bottom of a swimming pool and having a wheel support member that is adjustable in height.

FIG. 7 shows a second embodiment of the present invention having an elongated wheel support member 12 with one end of wheel support member 12 anchored to the bottom of swimming pool 8 by weight 6. Although not shown, it is also contemplated for wheel support member to be anchored to the bottom of a treatment vessel and other bodies of water. FIG. 7 also shows all paddles 4 attached to the side of wheel 10 remote from handle 14. In the second embodiment it is also contemplated for paddles 4 to be alternatively attached to the perimeter of wheel 10 so that paddles 4 extend radially beyond the perimeter of wheel 10. In addition, FIG. 7 shows handle 14 positioned adjacent to the perimeter of wheel 10 in a position offering maximum extension and motion for an operator's upper extremities (not shown) when the operator grips handle 14 and rotates wheel 10 in clockwise and counterclockwise directions. FIG. 7 further shows wheel support member 12 being made from two components, one of which telescopes within the other and each of which has several holes 32 therethrough adjacent to one of its ends. Thus it is contemplated for one or more fasteners (not shown) to be inserted through at least one hole 32 in each component to fix the overall length of wheel support member 12 so as to adjust the height of wheel 10 for people of differing statures. Also, by adjusting the height of wheel support member 12, the number of paddles 4 placed under water can be varied as an additional means of increasing or decreasing the amount of resistance offered by wheel 10 at it is rotated.

Figure 8:
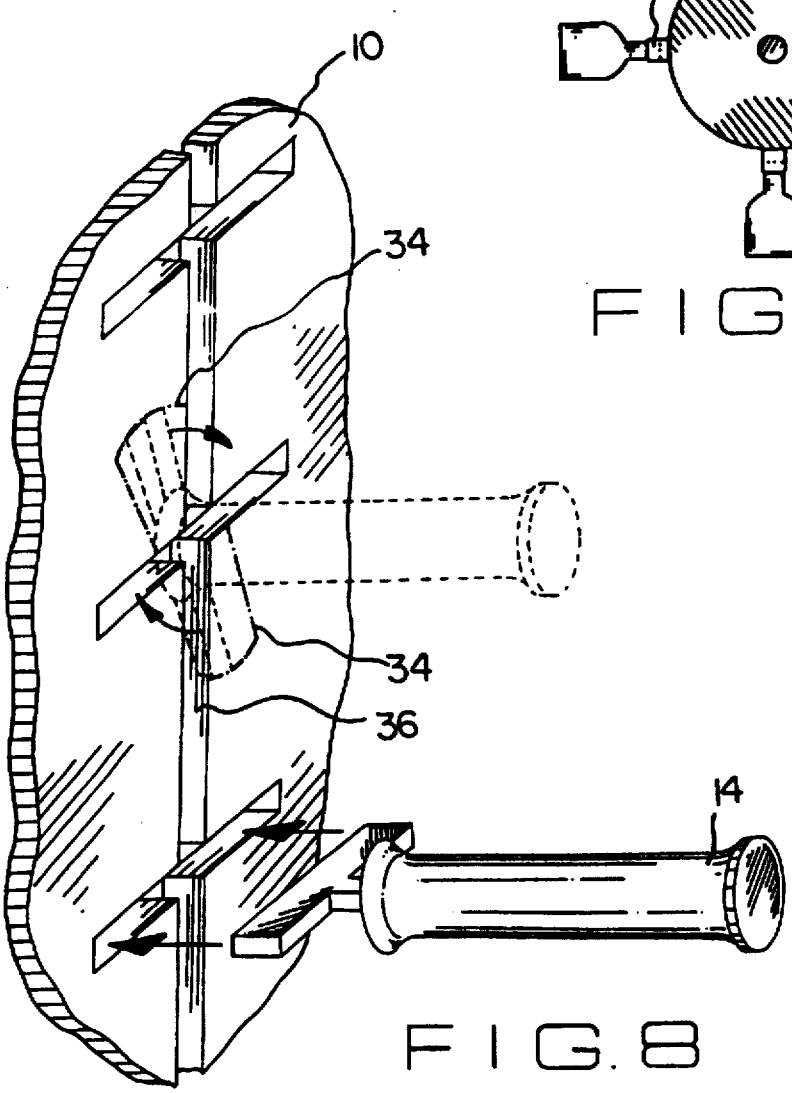
FIG. 8 is a perspective view of the grooves in the wheel for adjusting the position of the invention handle relative to the central axis of the wheel.

FIG. 8 shows wheel 10 having an elongated groove 36 therethrough, with a plurality of shorter grooves 34 also positioned through wheel 10, each shorter groove 34 intersecting elongated groove 36 and being approximately perpendicular thereto. The number of shorter grooves 34 through wheel 10 is not critical to the present invention. However, several shorter grooves 34 are contemplated to offer an operator varied amounts of upper extremity extension and motion during the rotation of wheel 10. In the preferred embodiment it is contemplated for handle 14 to have one of its ends dimensioned and configured for wedged insertion through each shorter groove 34 and slidable movement through elongated groove 36. During use in rotating wheel 10 about its central axis, it is also contemplated for the wedged end of handle 14 to be positioned obliquely to shorter groove 34. Although not shown, as an alternative to wedged attachment of handle 14 to wheel 10, it is also contemplated for the present invention to comprise a rotatable knob or lever for locking handle 14 in place within each shorter groove 34.

Figure 9:
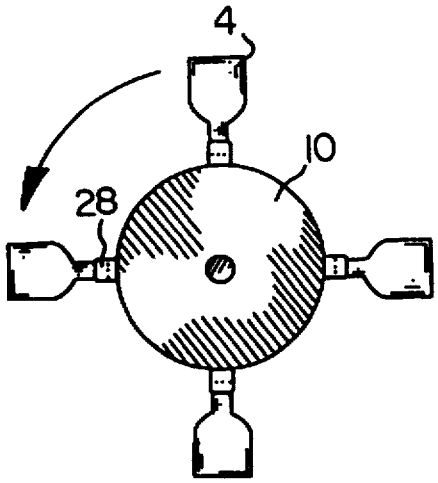
FIG. 9 is a front view of a second embodiment of the wheel having paddles attached to its perimeter so that the paddles extend outward radially beyond its perimeter.

FIG. 9 shows a second embodiment of wheel 10 having paddles 4 attached to its perimeter with casings 28 so that paddles 4 extend outward radially from its perimeter. Although four paddles 4 are shown, the number of paddles 4 used is not critical to the present invention. Attachment of paddles 4 to wheel 10 also allow movement of each paddle 4 between a first position of maximum resistance and a second position rotated ninety degrees therefrom and creating minimum resistance when moved through water.

To use the present invention in a swimming pool 8, an operator (not shown) would position one end of wheel support member 12 against a side wall or the bottom of pool 8 and anchor wheel support member 12 in place with weight 6. The operator could then use holes 32 in wheel support member 12 to adjust the height of wheel 10 to a comfortable level depending upon his or her stature and the water level in pool 8. Once positioned in front of wheel 10, the operator would place one of his or her hands on handle 14 to firmly grip it, and use handle 14 to rotate wheel 10 around its central axis in both clockwise and counterclockwise directions. As the resistance needs of the operator change, the orientation of one or more paddles 4 can be individually changed to increase or decrease resistance through the use of buttons 22 and their engagement with openings 24 in casings 28. As paddles 4 are positioned so as to become more parallel to the water's surface upon entry therein, resistance of the present invention is increased. As each paddle 4 is positioned so as to become more perpendicular to the water's surface upon entry therein, resistance of the present invention is decreased. Also handle 14 can be moved by the operator within elongated groove 36 and secured against one of several shorter grooves 34 to change the range of the operator's upper extremity extension and motion during rotation of wheel 10.

What is claimed is:

1. An exercise device for use under water to exercise muscles associated with an operator's upper extremities, said device comprising a wheel support member; a wheel having a central axis and opposite sides, said central axis of said wheel being connected to said wheel support member so that said wheel near the wheel's perimeter and coaxial with said central axis can move in both clockwise and counterclockwise directions; a plurality of paddles, each of said paddles being removably connected to said wheel; a first connection means to position each of said paddles into a variety of fixed orientations between a first position of maximum resistance and a second position rotated ninety degrees therefrom and creating minimum resistance during movement through water; a handle connected to the one of said opposite sides of said wheel adjacent to an operator; a second connection means to adjustably attach said handle to said wheel in different positions on said wheel relative to said central axis to provide an operator with differing amounts of upper extremity extension and motion during rotation of said wheel; and weighted means positioned against said wheel support member to anchor said wheel support member in place under water so that at least a portion of said paddles are positioned under water at any given time during use of said device and said device provides water resistance to muscles associated with the upper extremities of an operator when said operator is positioned adjacent to said wheel and uses a hand to grip said handle and while gripping said handle causes rotation of said wheel.

2. The device of claim 1 wherein each of said paddles is connected to the other of said opposite sides of said wheel in a position remote from an operator.

3. The device of claim 1 wherein said wheel also has a perimeter and each of said paddles is connected to said perimeter so as to extend radially outward beyond said perimeter.

4. The device of claim 1 wherein said wheel support member comprises height adjusting means.

5. An exercise device for use under water to exercise muscles associated with an operator's upper extremities, said device comprising a wheel support member; a wheel having a central axis and opposite sides, said central axis of said wheel being connected to said wheel support member so that said wheel can move in both clockwise and counterclockwise directions; a plurality of casings attached to said wheel near the wheel's perimeter and coaxial with said central axis; a plurality of paddles, each of said paddles being removably connected to one of said casings; a first connection means to position each of said paddles into a variety of fixed orientations between a first position of maximum resistance and a second position rotated ninety degrees therefrom and creating minimum resistance during movement through water; a handle connected to the one of said opposite sides of said wheel adjacent to an operator; a second connection means to adjustably attach said handle to said wheel in different positions on said wheel relative to said central axis to provide an operator with differing amounts of upper extremity extension and motion during rotation of said wheel; and weighted means positioned against said wheel support member to anchor said wheel support member in place under water so that at least a portion of said paddles are positioned under water at any given time during use of said device and said device provides water resistance to muscles associated with the upper extremities of an operator when said operator is positioned adjacent to said wheel and uses a hand to grip said handle and while gripping said handle causes rotation of said wheel.

6. The device of claim 5 wherein said first connection means comprises a plurality of holes through each of said casings and a plurality of locking buttons, each of said paddles having at least one of said lock buttons attached thereto.

7. The device of claim 6 further comprising spring means associated with each of said locking buttons to outwardly bias said locking button into an extended position.

8. The device of claim 5 wherein each of said paddles is connected to the other of said opposite sides of said wheel in a position remote from an operator.

9. The device of claim 5 wherein said wheel also has a perimeter and each of said paddles is connected to said perimeter so as to extend radially outward beyond said perimeter.

10. The device of claim 5 wherein said wheel support member comprises height adjusting means.

11. The device of claim 5 wherein said wheel support member is configured for attachment over side walls of swimming pools and other vessels containing water which are sufficiently sized to contain said device and an operator positioned adjacent thereto.

12. The device of claim 5 wherein said wheel support member is configured for support on the bottom of swimming pools and other bodies of water which are sufficiently sized to contain said device and an operator positioned adjacent thereto.

13. The device of claim 5 wherein said second connection means comprises a plurality of grooves through said wheel and handle is configured for insertion through said grooves and engaging said grooves to securely attach said handle to said wheel.

14. A method for exercising muscles associated with the upper extremities of a person, said method comprising the steps of providing a wheel, a plurality of casings; a plurality of paddles, a handle, a wheel support member, and a weight; attaching one end of each of said casings to said wheel; positioning one end of each of said paddles within the distal end of one of said casings; orienting said paddles within said casings to provide a desired amount of resistance when said paddles are moved through water; attaching said handle to said wheel in a position relative to the central axis of said wheel to provide a desired amount of upper extremity muscle extension and motion to a person using the device; positioning said wheel support member against a pool wall; anchoring said wheel support member upon said pool wall with said weight; and connecting said wheel to said wheel support member so that said wheel can be rotated in both clockwise and counterclockwise directions by the hand of an operator gripping said handle to provide exercise to muscles associated with the upper extremities of said operator.

* * * * *